United States Patent [19]

Zimmer et al.

[11] 4,366,599

[45] Jan. 4, 1983

[54] CHAIR HINGE

[76] Inventors: Peter G. Zimmer; Diethelm von Lieres, both of Port Hood, Nova Scotia, Canada, B0E 2W0

[21] Appl. No.: 200,082

[22] Filed: Oct. 23, 1980

[51] Int. Cl.[3] ..... E05D 5/10

[52] U.S. Cl. ..... 16/386; 16/361; 297/378

[58] Field of Search ..... 16/173, 166, 168, 191, 16/192, 361, 366, 386, 373; 297/378

[56] References Cited

U.S. PATENT DOCUMENTS

| | | | |
|---|---|---|---|
| 2,705,525 | 4/1955 | Bartolucci | 16/191 X |
| 2,733,476 | 2/1956 | Eck | 16/173 X |
| 2,805,016 | 9/1957 | Brooking et al. | 16/168 X |

FOREIGN PATENT DOCUMENTS

| | | | |
|---|---|---|---|
| 1285913 | 12/1968 | Fed. Rep. of Germany | 16/168 |

*Primary Examiner*—Werner H. Schroeder
*Assistant Examiner*—Andrew M. Falik
*Attorney, Agent, or Firm*—Burns, Doane, Swecker & Mathis

[57] ABSTRACT

A hinge structure is disclosed which is especially suited for use in a double pivot hinge connecting together two panels for pivotal movement in their common plane. Such panels may be the frame members of a folding chair. In each panel, an aperture is provided having a partly circular socket portion and having two opposed abutment surfaces lying transverse to a circular arc centered on the socket portion, and a bushing is located in each socket portion. The two panels are connected by a rod having its opposite ends forming shaft portions rotatable within the bushings and having a lever portion extending along the outer surfaces of the panels and forming a connection between the panels, and having intermediate portions connecting the lever and shaft portions and configured to contact the abutment surfaces to limit pivotal movement of the rod relative to the two panels. The apertures are shaped to allow insertion of the rod member with the bushings mounted thereon, so that the whole hinge assembly can easily be assembled.

7 Claims, 4 Drawing Figures

CHAIR HINGE

BACKGROUND OF THE INVENTION (1) Field of the Invention

The present invention relates to a hinge structure for providing limited pivotal movement between two parts or members. The structure is especially suitable for connecting together parts of folding furniture, especially parts in the form of panels for example the frame members of a folding chair, and is designed so that such furniture can be sold disassembled and can be assembled easily by the purchaser installing the hinges. The structure is especially suitable for forming a double pivot hinge, where the hinge structure includes a connecting part between two members, each of which member is provided with limited movement only relative to the connecting part.

(2) Prior Art

A particular form of chair for which the hinge structure of this invention is useful is a rocking reclining chair having seat and back portions of similar dimensions, with both the seat and back portions having a continuous curved surface which can rock on a floor or a platform. The chair may be balanced so that it can be reclined by a person changing the position of their weight on the chair. A chair of this general nature, which however is not foldable, is described in the book "Nomadic Furniture" by James Hannessey and Victor Papanek, published by Pantheon Books, New York, in 1973. Such a chair occupies a lot of space when not in use. The hinge of this invention was designed so that such a chair could be folded and stand upright on a level surface contacted by the normally mating ends of the back portion and seat portion.

In order for the chair, when folded, to be stable the hinge which connects the back portion and seat portion must limit the movement of these portions relative to each other. The invention accordingly provides a simple hinge structure which is of the double pivot type to allow full folding of the back portion and seat portion, and which includes a connecting part between the two pivots and movement limiting means by which each portion connected by the hinge has limited movement relative to this connecting part. Hinge arrangements having double pivot pins are of course known per se and shown for example in Canadian Pat. Nos. 225,347; 809,861 and 916,871, and in German Pat. No. 1,285,913. However, none of these patents show the kind of movement limiting means which is an important feature of this invention.

BRIEF SUMMARY OF THE INVENTION

In accordance with the present invention, a hinge structure comprises a member, for example a frame member or panel, having an aperture with a socket portion which is preferably partly circular, and two opposed abutment surfaces lying transverse to a circular arc centered on the socket portion, with a bushing being located in the socket portion. A rod is provided having a shaft portion rotatable within the bushing, a lever portion extending transversely of the shaft portion, and a stop portion spaced radially of the shaft portion and configured to contact the abutment surfaces to limit pivoting movement of the rod relative to the member. The aperture is shaped to allow insertion of the rod with the bushing mounted thereon as a unit.

In order to limit axial movement of the rod within the bushing, without relying on contact between bent portions of the rod and the bushing, the shaft portion is preferably an end portion of the rod and has its extremity lying within a cap on the bushing and so that with the bushing secured the rod cannot come out. In this case parts of the rod may extend radially from the shaft portion to the stop portion, and these parts with the lever portion form a loop with the lever portion lying just outside the cap so that contact between the lever portion and the cap also assists in limiting axial movement of the rod.

BRIEF DESCRIPTION OF THE DRAWINGS

The invention will be described in detail with reference to the accompanying drawings, in which.

DETAILED DESCRIPTION OF THE INVENTION

Figure 1:
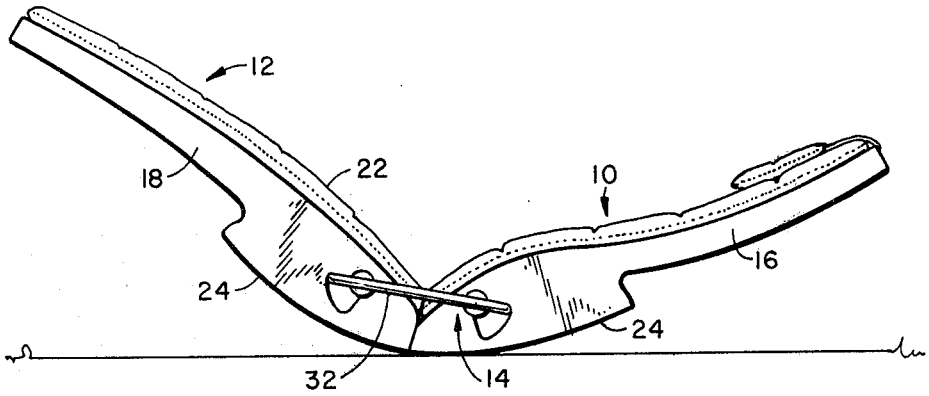
FIG. 1 shows a side elevation of a folding chair when ready for use, and which incorporates the hinge construction of this invention.
Figure 2:
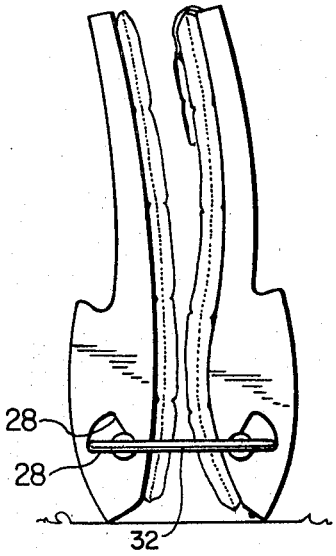
FIG. 2 shows a side elevation of the same chair when folded.

The chair shown in FIGS. 1 and 2 is a folding, reclining chair having a back section 10 and a seat section 12, which are connected on each side by a double pivot hinge 14 each end of which is formed as a hinge construction in accordance with the invention.

Figure 4:
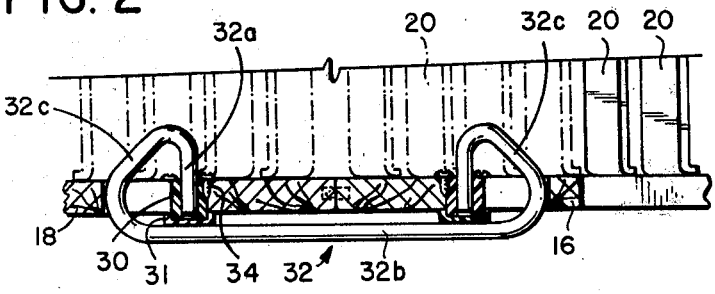
FIG. 4 is an enlarged sectional view on lines 4—4 of FIG. 1.

Each section of the chair has two flat side members or panels 16, 18, which are interconnected by slats 20 shown in FIG. 4 to give a rigid frame. The slats will normally support cushions 22 as indicated in FIGS. 1 and 2. The side members each have a base part the lower surfaces 24 of which are formed as a continuous curve to allow the chair to rock on a level surface. The chair is balanced so that an occupant can assume a feet up reclining position by raising his arms above his head.

The hinge arrangement connecting the sections allows the chair to be folded into the position shown in FIG. 2, and the use of double pivot hinges allows the sections to be spaced apart when folded to accommodate the cushions.

Figure 3:
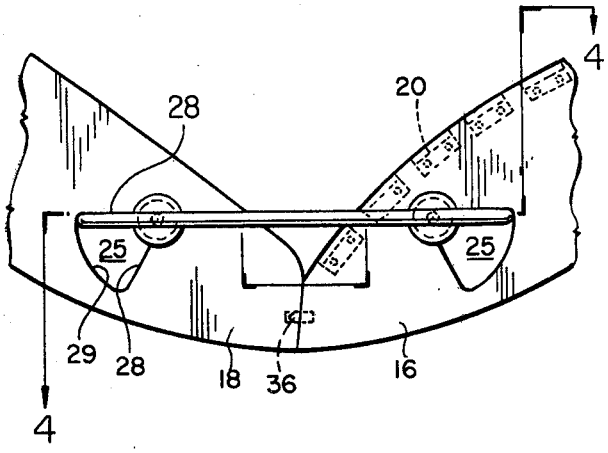
FIG. 3 shows an enlarged side elevation of the hinge construction.

As particularly seen in FIGS. 3 and 4, on each side the hinges are accommodated by apertures 25 formed in the side members 16, 18. Each aperture is of generally triangular form having in one corner a partly circular socket portion the cylindrical surface of which subtends an angle of about 270° at the center. Extending roughly radially from the socket portion are two opposed abutment surfaces 28, joined by an arched surface 29 which is centered on the socket portion.

Within the socket portion of each aperture there is fitted a bushing 30 of plastic material, provided with a cap 31 having a flange which engages the sides of the bushing. The hinge construction is completed by a rod 32 having its opposite ends providing shaft portions 32*a* co-axial with and rotatable in the bushings, having a connecting lever portion 32*b* extending between the members 16 and 18 and spaced parallel to and slightly outside the outer surface of these members, and having intermediate portions 32*c* which include stop portions traversing the side members and engaging the abutment surfaces 28. The intermediate portions, together with the shaft portions 32*a* and the adjacent ends of portion 32*b*, form a loop so that the end of the shaft portion is adjacent the connecting portion 32*b*, but spaced sufficiently to accommodate the cap 31. With this construction, the rod is fixed firmly in place when the bushing is secured in the socket as by wood screws 34, since axial movement of the shaft portion is limited by engagement of its extremity within the cap and engagement of lever portion 32*b* on the outside of the cap.

It will be seen with reference to FIGS. 1 and 2 that this hinge arrangement allows each section to pivot about the shaft portions 32*a* of the rod between the operative position in which the intermediate rod portions 32*c* abut the upper abutment surfaces 28 of the apertures, and the folded position shown in FIG. 2 in which the rod portions 32*c* abut the lower abutment surfaces of the apertures. Preferably these abutment surfaces are formed so as to be aligned with the adjacent sides of the rod in these positions. The limited pivotal movement provided by this hinge construction ensures that the abutting portions of the two sections are reasonably well aligned in the operative position of FIG. 1, and that in the FIG. 2 folded position the rod 32 cannot move relative to the two sections so that the folded chair remains upright on a level surface. Since the alignment provided by the hinge construction is however not exact, it is preferred to make a projection 36 on the end of each member 16 which registers with a corresponding notch in the member 18 to ensure exact alignment in the operative position.

For the chair as described, rod 32 may conveniently be formed of ½ inch (1.270 cm) diameter aluminum bar. When the chair is in use, the end portions of the bar adjacent the apertures will be subject to some deflection providing a slight spring effect between the two sections.

A particular feature of this hinge construction is its easy installation.

The chair will normally be shipped in separate parts including the two sections 10 and 12, and the two hinge units comprising the rods 32 with the bushings and caps assembled. Each bushing 30 is a partly split bushing having a slit extending across the majority of its diameter but leaving a flexible web connecting the two parts. The bushing is assembled on rod portion 32*a* by the manufacturer and the cap 31 is slid into place; the side flange of the cap has a notch to allow the extremity of the shaft portion to pass through it. With the cap 31 in place, the bushing is closed and pushed into the flanges of the cap where it may be welded in place.

The customer or retail store receiving the separate parts can assemble them very easily by merely aligning the two sections and pushing the assembly including the rod, bushings and caps into place with the bushings sliding into the socket portions of the apertures. The bushings can then be secured by the wood screws 34 inserted between the bushings and the wood of the panel from the interior of the frame member.

For some purposes, it may be desirable to provide a detent arrangement for releasably holding the hinge members at the extreme positions of movement or intermediate positions. With the hinge construction of this invention, such detent can be provided by making the surfaces 29 of the apertures interfere with the rod and forming notches in these surfaces, such as to hold the rod portions 32*c* at selected positions, or by installing projecting catches in surface 29.

Many variations of the design described may be used in accordance with the invention.

Thus, the bushing, and the socket portion of the aperture, need not be circular, provided that the bushing can be properly located relative to the aperture. Also, the bushing might be formed integrally with the cap by injection molding. To retain the bushing in the panel, various means other than wood screws may be used including self-gripping teeth on the bushing, or a snap ring inserted into a groove surrounding the bushing.

Furthermore, the loop formation at the end of the rod is not essential, but is a convenient way of locating the shaft portion of the rod axially without relying on bent portions of the rod engaging the ends of the bushing since this could cause binding. However, other arrangements could be used provided that there is a portion of the rod capable of acting as a stop against abutment surface 28; axial movement of the shaft portion could be prevented by other means such as a transverse pin through the bushing engaging in a groove in the shaft portion. It may be noted that only the shaft portions of the rod needs to be round.

Lastly, the aperture in the panel does not need to be shaped as shown provided that it has a suitable locating part for the bushing, two abutment surfaces lying transverse to an arc centered on the socket portion, and space for allowing the rod parts to be pushed into place when the bushing has been assembled on the rod.

We claim:

1. A hinge structure comprising:

a member having an aperture with a socket portion and having two opposed abutment surfaces lying transverse to a circular arc centered on said socket portion, a bushing located in said socket portion, and a rod having a shaft portion rotatable within said bushing, a lever portion extending transversely of the shaft portion, and a stop portion spaced radially of the shaft portion and configured to contact said abutment surfaces to limit pivoting movement of said rod relative to the member, said aperture being shaped to allow insertion of said rod with the bushing mounted thereon as a unit, the rod being configured so that when the bushing is held in place the rod is restricted in movement axially of the bushing.

2. A hinge structure according to claim 1, wherein the shaft portion of the rod is an end portion thereof which has an extremity lying within a cap on said bushing, and wherein said rod extends partly radially from said shaft portion to the stop portion which latter portion passes through the aperture and connects to said lever portion.

3. A hinge structure according to claim 2 wherein said shaft, said stop portion, and said lever portion form a loop with the end of the shaft portion spaced slightly from said lever portion to allow said cap to be positioned therebetween, said bushing being a split bushing; whereby axial movement of the shaft portion is limited by engagement of the shaft portion extremity and of the lever portion with the cap.

4. A double hinge structure for connecting two members having substantially co-planar surfaces, said structure allowing pivoting of said members in a common plane and comprising:

an aperture in each of said members, each aperture being of identical shape and having a socket portion and two opposed abutment surfaces lying transverse to a circular arc centered on said socket portion, a bushing located in each of said socket portions, and a rod having its opposite ends forming shaft portions rotatable within said bushings, a lever portion extending along said surfaces of said members and forming a connection between said members, and stop portions spaced radially of the shaft portions and configured to contact said abutment surfaces to limit pivoting movement of said rod relative to the members, said apertures being shaped to allow insertion of said rod with the bushings mounted thereon as a unit.

5. A double pivot hinge structure according to claim 4 wherein the shaft portions of the rod are end portions thereof and have extremities lying within caps on said bushings, and wherein said rod extends partly radially from said shaft portions to the stop portions which latter portions pass through said apertures in connecting on to said lever portion.

6. A double pivot hinge structure according to claim 5 wherein said shaft portions, said stop portions, and said lever portion form loops with the ends of the shaft portions spaced slightly from said lever portion to allow said caps to be positioned therebetween, said bushings being split, whereby axial movement of the shaft portions are limited by engagement of the extremities thereof and of the lever portion with the cap.

7. A folding chair having a back section and a seat section pivotable relative to each other, each section including a pair of frame members with the frame members of the back section aligned with those of the seat section, and further including a double hinge structure in accordance with any of claims 4 to 6 connecting adjacent ends of each of said frame members.

* * * * *